US007954550B2

(12) United States Patent
Anderson

(10) Patent No.: US 7,954,550 B2
(45) Date of Patent: Jun. 7, 2011

(54) TUBING PRESSURE INSENSITIVE CONTROL SYSTEM

(75) Inventor: David Z. Anderson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 232 days.

(21) Appl. No.: 12/270,080

(22) Filed: Nov. 13, 2008

(65) Prior Publication Data

US 2010/0116502 A1 May 13, 2010

(51) Int. Cl.
*E21B 34/00* (2006.01)
*E21B 33/00* (2006.01)
*E21B 43/00* (2006.01)

(52) U.S. Cl. ..... 166/321; 166/332.2

(58) Field of Classification Search ..... 166/72, 166/316, 319, 321, 324, 332.2, 332.8
See application file for complete search history.

(56) References Cited

U.S. PATENT DOCUMENTS 4,495,998 A * 1/1985 Pringle ..... 166/321
6,109,351 A 8/2000 Beall et al.
6,427,778 B1 8/2002 Beall et al.
6,513,594 B1 * 2/2003 McCalvin et al. ..... 166/320
7,255,174 B2 8/2007 Thompson
2008/0066921 A1 3/2008 Bane et al.
2008/0110611 A1 * 5/2008 Bane et al. ..... 166/53
2008/0128137 A1 6/2008 Anderson et al.

OTHER PUBLICATIONS

Bane, Darren, E., et al., "Subsurface Safety Valve Control System for Ultradeepwater Application", OTC 19870, May 2009, 1-4.
Arrazola, A., et al., "Design Methodologies for Upper Completion Deepwater Subsea and Dry Tree Applications", SPE 123034, May 2009, 1-15.
Vinzant, Mike, et al., "A Unique Design for Deep-Set Tubing-Retrievable Safety Valves Increases Their Integrity in Ultra Deepwater Applications", SPE 90721, Sep. 2004, 1-9.

* cited by examiner

*Primary Examiner* — William P Neuder
*Assistant Examiner* — Sonya Bible
(74) *Attorney, Agent, or Firm* — Steve Rosenblatt

(57) ABSTRACT

A system isolates a control system for a downhole tool from the internal pressures in the tubing in which the tool is mounted. Opposed seals are used on a moving component in the tool so as to offset pressure induced forces regardless of the internal operating pressure of the tool. In a particular application to a subsurface safety valve the control system can be isolated from tubing pressure by offset seals between the passage and the flow tube or around exposed portions of the operating piston for the flow tube.

9 Claims, 2 Drawing Sheets

TUBING PRESSURE INSENSITIVE CONTROL SYSTEM

FIELD OF THE INVENTION

The field of this invention is control systems for downhole valves and, more particularly, for subsurface safety valves where the system is tubing pressure insensitive.

BACKGROUND OF THE INVENTION

Subsurface safety valves are used in wells to close them off in the event of an uncontrolled condition to ensure the safety of surface personnel and prevent property damage and pollution. Typically these valves comprise a flapper, which is the closure element and is pivotally mounted to rotate 90 degrees between an open and a closed position. A hollow tube called a flow tube is actuated downwardly against the flapper to rotate it to a position behind the tube and off its seat. This is described as the open position. When the flow tube is retracted the flapper is urged by a spring mounted to its pivot rod to rotate to the closed position against a similarly shaped seat.

The flow tube is operated by a hydraulic control system that includes a control line from the surface to one side of a piston. Increasing pressure in the control line moves the piston in one direction and shifts the flow tube with it. This movement occurs against a closure spring that is generally sized to offset the hydrostatic pressure in the control line, friction losses on the piston seals and the weight of the components to be moved in an opposite direction to shift the flow tube up and away from the flapper so that the flapper can swing shut.

Normally, it is desirable to have the flapper go to a closed position in the event of failure modes in the hydraulic control system and during normal operation on loss or removal of control line pressure. The need to meet normal and failure mode requirements in a tubing pressure insensitive control system, particularly in a deep set safety valve application, has presented a challenge in the past. The results represent a variety of approaches that have added complexity to the design by including features to ensure the fail safe position is obtained regardless of which seals or connections fail. Some of these systems have overlays of pilot pistons and several pressurized gas reservoirs while others require multiple control lines from the surface in part to offset the pressure from control line hydrostatic pressure. Some recent examples of these efforts can be seen in U.S. Pat. Nos. 6,427,778 and 6,109,351.

Despite these efforts a tubing pressure insensitive control system for deep set safety valves that had greater simplicity, enhanced reliability and lower production cost remained a goal to be accomplished. The present invention provides a solution for this concern by isolating the control system from tubing pressure by sealing the internal passage of the valve around the flow tube. The seals are designed to be as nearly equal in dimension as possible so that internal tubing pressure provides a minimal or no net measurable force on the flow tube for the full range of expected tubing pressures. As an alternative, the operating piston of the control system can also have a portion exposed to tubing pressure with seals of equal or nearly equal diameters to get the same result of insensitivity to tubing pressure. Those skilled in the art will more readily understand the invention from a review of the description of the preferred embodiment and the associated drawings while recognizing that the full scope of the invention is measured by the attached claims.

SUMMARY OF THE INVENTION

A system isolates a control system for a downhole tool from the internal pressures in the tubing in which the tool is mounted. Opposed seals are used on a moving component in the tool so as to offset pressure induced forces regardless of the internal operating pressure of the tool. In a particular application to a subsurface safety valve the control system can be isolated from tubing pressure by offset seals between the passage and the flow tube or around exposed portions of the operating piston for the flow tube.

DETAILED DESCRIPTION OF THE PREFERRED EMBODIMENT

Figure 1:
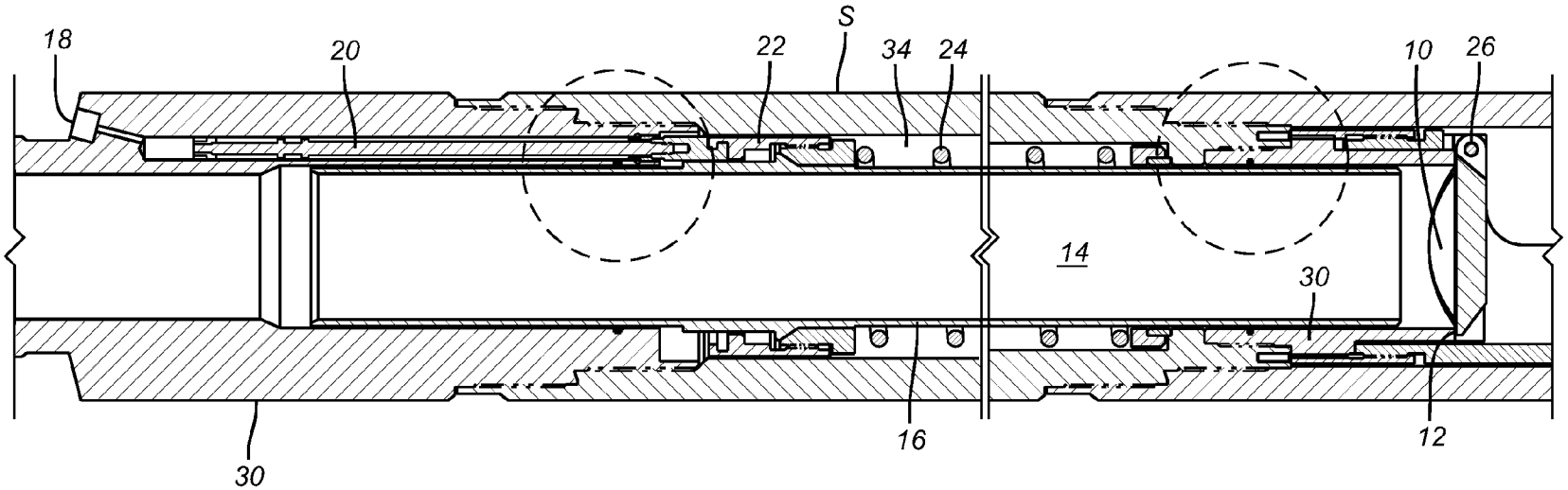
FIG. 1 is an elevation view of a subsurface safety valve in the closed position showing the seal placement.

FIG. 1 is an overall view of a subsurface safety valve S showing a flapper 10 in a closed position against a seal 12. The flow passage 14 has a flow tube 16 mounted in it for selective contact with the flapper 10 for opening the valve. A control line (not shown) is connected at connection 18 and when pressurized the operating piston 20 responds by moving down. The operating piston 20 is linked at 22 to the flow tube 16 for tandem movement. A closure spring 24 is compressed by downward movement of the piston 20. When the applied pressure at connection 18 is removed or the pressure is lost due to an operating problem, the closure spring 24 raises the operating piston 20 which raises the flow tube 16 which in turn allows the flapper 10 to rotate back against its seat 12 due to a pivot spring (not shown) around mounting axis 26.

Figure 2:
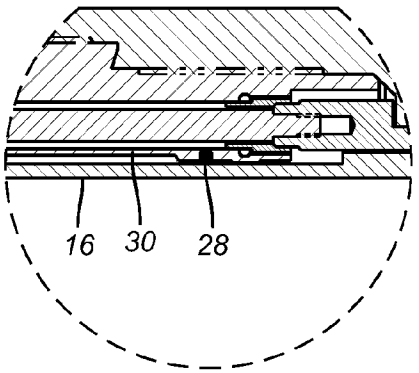
FIG. 2 is a detailed view of the upper seal placement.
Figure 3:
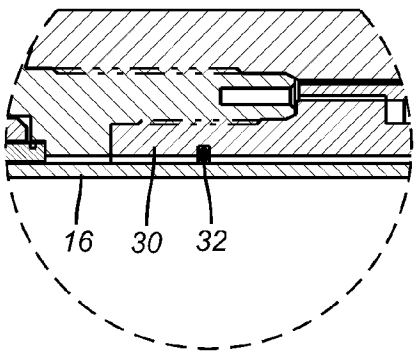
FIG. 3 is a detailed view of the lower seal placement.
Figure 4:
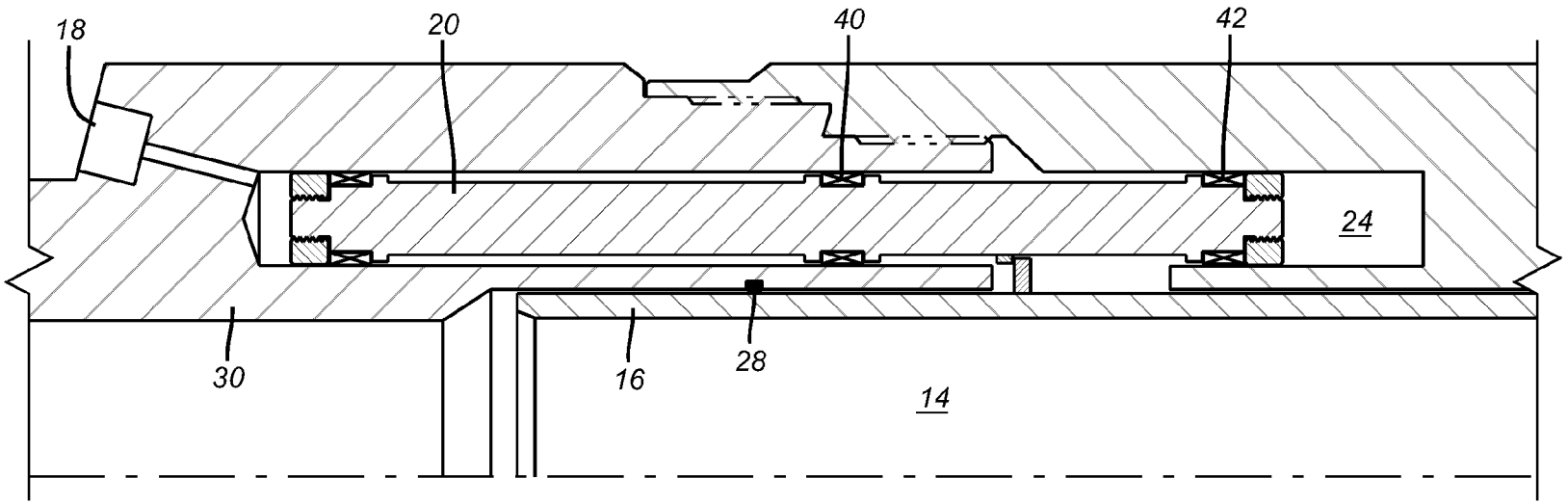
FIG. 4 is an alternative embodiment to FIG. 1 showing the piston in pressure balance to tubing pressure if the flow tube seal or seals leak.

To isolate the piston 20 from pressure in passage 14 an upper seal 28 is shown in FIG. 2 between the flow tube 16 and the body 30 preferably mounted in a recess in the body 30. Another seal 32 is shown in FIG. 3 again between the body 30 and the flow tube 16. Ideally the seals 28 and 32 are identical so that internal pressure in passage 14 creates opposing and offsetting forces so that the pressure level in the passage 14 has no effect on the flow tube 16. Making the flow tube 16 pressure insensitive to tubing pressure allows the closure spring 24 to be smaller because it doesn't have to compensate for a material net force on the flow tube 16 from passage 14. All the closure spring 24 needs to respond to in a single line control system connected at 18 is the hydrostatic pressure in the control line (not shown). With seals 28 and 32 disposed as shown, the piston 20 whether it is one or more rods or an annular piston, is not exposed at all to pressure in passage 14. A an alternative to seals 28 and 32 between the flow tube 16 and the body 30 opposed substantially identical seals can be placed on the piston 20 so that pressure in passage 14 reaches the piston 20 but there is no net pressure effect because there are offsetting forces on a pair of substantially identical seals on the piston 20. Alternatively, as shown in FIG. 4, seals that generate opposing forces that cancel themselves can be positioned between the flow tube 16 and the body 30 as well as on piston 20 in the form of seals 40 and 42 so that if the seals 28 and 32 fail, the tubing pressure in passage 14 is still retained and the piston 20 no exposed to such pressure will then be in pressure balance from tubing pressure in passage 14. Those skilled in the art will appreciate that the body 30 will have a different configuration to accommodate seals on the piston 20. In essence some mid portion of the piston 20 will have to extend between lower and upper segments of the body 30 so that a middle portion is exposed to passage 14 with the pair of seals that put the piston in pressure balance disposed respectively one in the upper housing and another in the lower housing and both being disposed about the piston 20 with opposed seal areas to create substantially offsetting forces. Again doing that is for a backup and the preferred embodiment relates to seal placement between the flow tube 16 and the body 30 as the first line of defense to keep tubing pressure in passage 14 from imparting a substantial or any net force on the closure spring 24.

Those skilled in the art will further appreciate that the body 30 can be configured to allow a closed chamber 34 where the spring 24 is now shown so that a two control line system can be used to offset control line hydrostatic pressure to allow using an even smaller spring 24 than can be used by isolation of the control system piston 20 from control line pressure using seals 28 and 32. Alternatively, a pressurized chamber in housing 30 can be used to offset control line hydrostatic pressure and elimination of the spring 24 in a single or dual control line system. It should be noted that chamber 34 can be at atmospheric pressure on tool assembly at the surface and that the movement of piston 20 changes the volume of chamber 34 with a slight pressure buildup that is not significant in aiding the closure spring 24 in closing the valve by moving the flow tube 16. Alternatively, chamber 34 can be initially charged with a high enough pressure on assembly that will offset hydrostatic pressure in the control line at the expected depth of use of the safety valve. Another option to offset hydrostatic on the back end of the piston 20 is to run a second control line which will offset the hydrostatic pressure in the control line going to connection 18.

While the preferred application is a subsurface safety valve other tools that have a control line system to actuate a piston to in turn move a component in a downhole tool can also benefit from sealing around the component to be ultimately operated by the piston of the control system that is in turn operated by applied control line pressure. Some examples can be other types of valves such as a ported sleeve actuated by a sliding sleeve or a ball type valve triggered remotely by surface applied hydraulic pressure, for some examples.

The above description is illustrative of the preferred embodiment and various alternatives and is not intended to embody the broadest scope of the invention, which is determined from the claims appended below, and properly given their full scope literally and equivalently.

I claim:

1. A downhole tool operable with hydraulic pressure, comprising:

a housing having a passage therethrough between connections for mounting to a tubing string and at least one control system connection for delivery of hydraulic pressure;

a movable element in said passage exposed to pressure therein;

an actuation system responsive to the pressure delivered to said control system connection for selectively moving said movable element;

said movable element comprises a flow tube mounted for reciprocal motion for rotation of a flapper mounted in said passage by selective pressure application to said control system connection;

flow tube seals disposed between said flow tube and said housing to put said flow tube in pressure balance from pressures in said passage;

said control system further comprises an operating piston connected to said flow tube between said flow tube seals, said flow tube seals isolating said piston from pressure in said passage;

said flow tube seals are mounted to either or both said housing and said flow tube;

said piston comprises identical spaced piston seals exposed to passage pressure if at least one of said flow tube seals contacting said flow tube fail;

a portion of said piston between said piston seals is in pressure balance to passage pressure if at least one of said flow tube seals contacting said flow tube fail.

2. The tool of claim 1, wherein:

said flow tube seals are spaced apart and said control system further comprises a connection to said movable element between said flow tube seals.

3. The tool of claim 2, wherein:

said control system comprises a piston that is isolated from pressure in said passage due to said flow tube seals.

4. The tool of claim 2, wherein:

said control system comprises a closure spring acting on said connection and isolated from pressure in said passage due to said flow tube seals.

5. The tool of claim 2, wherein:

said flow tube seals are mounted to said housing and said movable component moves respectively to said flow tube seals which are fixed.

6. The tool of claim 1, wherein:

said flow tube seals are mounted to said movable component and engage said housing.

7. The tool of claim 1, wherein:

said portion of said piston comprises identical spaced piston seals exposed to passage pressure if at least one of said flow tube seals contacting said flow tube fail.

8. The tool of claim 1, wherein:

said flow tube seals are mounted in grooves in said flow tube.

9. The tool of claim 1, wherein:

said flow tube seals are mounted in grooves in said housing.

* * * * *